US005639138A

United States Patent [19]

Smith

[11] Patent Number: 5,639,138

[45] Date of Patent: Jun. 17, 1997

[54] PORTABLE DISPLAY AND STORAGE STAND FOR FLAGS

[76] Inventor: Randy Smith, 10853 Edgewood Rd., Harrison, Ohio 45030

[21] Appl. No.: 564,410

[22] Filed: Nov. 29, 1995

[51] Int. Cl.[6] ..... A47B 43/00; A45F 5/10

[52] U.S. Cl. ..... 294/142; 294/137; 211/195; 211/DIG. 1; 248/439

[58] Field of Search ..... 294/65.5, 137, 294/141–143, 159–163; 211/13, 195, DIG. 1; 248/206.5, 309.4, 439, 528, 537; 40/600, 610, 621

[56] References Cited

U.S. PATENT DOCUMENTS

| | | | |
|---|---|---|---|
| D. 246,965 | 1/1978 | Hughes . | |
| 457,598 | 8/1891 | Briggs . | |
| 1,406,097 | 2/1922 | Snickers . | |
| 1,531,070 | 3/1925 | Bruns | 40/621 |
| 1,541,211 | 6/1925 | Ford . | |
| 1,977,466 | 10/1934 | Bohnke . | |
| 2,260,787 | 10/1941 | Nichols et al. . | |
| 2,298,744 | 10/1942 | Liermann . | |
| 2,602,617 | 7/1952 | Muth . | |
| 2,733,113 | 1/1956 | Humbargar | 211/DIG. 1 |
| 2,975,539 | 3/1961 | Anderson | 40/621 |
| 3,294,251 | 12/1966 | Howell | 211/195 |
| 3,755,938 | 9/1973 | Bytwork | 40/621 |
| 4,081,119 | 3/1978 | Messmore | 40/610 |
| 4,226,040 | 10/1980 | Carroll et al. | 40/610 |

*Primary Examiner*—Dean Kramer
*Attorney, Agent, or Firm*—Wood, Herron & Evans, L.L.P.

[57] ABSTRACT

A portable flag stand is described which is designed for supporting flags having magnetic base portions and to improve the storage, portability, and arrangement of such flags. The portable flag stand includes a main body portion, a handle and a fold out support for propping the stand in an open position.

13 Claims, 1 Drawing Sheet

PORTABLE DISPLAY AND STORAGE STAND FOR FLAGS

FIELD OF THE INVENTION

This invention relates to a portable display and storage stand for flags, and more particularly to a stand for displaying and storing a plurality of flags, such as ceremonial flags, having magnetic base portions.

BACKGROUND OF THE INVENTION

Relatively small flags having magnetic base portions are used in funeral processions and other ceremonial contexts to identify vehicles that are part of the funeral procession or ceremony. Typically one flag is releasably secured to each vehicle in the funeral procession, thus requiring a supply of numerous flags for the procession. Prior to distribution to participants in the funeral procession, the flags are generally placed in a group on the ground or on a tray from which the participants select a flag and mount it to their vehicle. There are various drawbacks associated with simply placing the flags on the ground or on a tray. With this arrangement, the flags are typically disorganized, inhibiting the accessibility and distribution of the flags for the funeral procession. Additionally, transporting a plurality of flags is difficult, increasing the handling of the flags and subjecting the flags to increased wear and tear. Furthermore, setting the flags on the ground or on a tray that does not securely hold them may result in the flags becoming soiled when they come in contact with the ground. Moreover, being on the ground subjects the flags to the possibility of being run over by a vehicle in the procession since they may be difficult for a driver to see. In addition to the above drawbacks, no provision is made for storing the flags when not in use.

There is a distinct need for a flag stand which organizes a plurality of flags having magnetic base portions in a manner that makes the flags easily accessible for distribution, prevents the flags from contacting the ground and becoming soiled, is easily transportable, and can be used to store the flags.

SUMMARY OF THE INVENTION

The present invention is directed to a free-standing, portable, magnetic display and storage stand for a plurality of ceremonial flags, such as funeral procession flags, having magnetic base portions. The invention is intended to improve the organization, transportability, accessibility, distribution and storage of the flags. Furthermore, the flag stand is designed so that the flags do not come in contact with the ground, thereby preventing soiling of the flags.

In its broadest aspects, the flag stand of the present invention includes a main body plate, one side of which is adapted for releasably securing flags that have a magnetic base portion. The flag stand further includes a support leg pivotally mounted at one end to the main body plate, albeit to the side opposite the securing surface, thereby allowing the flag stand to be propped up in its usable position. When the flag stand is not being used to display the flags, the support can be pivoted to a closed, storage position. A suitable fastener attached to either or both of the main body plate and the support leg releasably secures the support leg in a closed position. The flag stand may also have a handle that is either integral with the main body plate or is a separate element coupled to the main body plate of the flag stand. The handle allows the flag stand to be readily transported.

In a preferred embodiment, the main body plate itself may be made of a material that is not adapted for releasably securing flags with magnetic base portions, such as plastic. In this embodiment, a sheet metal surface plate is affixed to the main body plate and acts to releasably secure flags to the flag stand. This embodiment also includes a support leg with one end pivotally coupled to the main body plate, allowing the support leg to be moved into display and storage orientations.

In addition to the foregoing, further features and advantages of the present invention will become apparent to persons skilled in the art upon review of the following detailed description taken in conjunction with the drawings.

DETAILED DESCRIPTION

Figure 1:
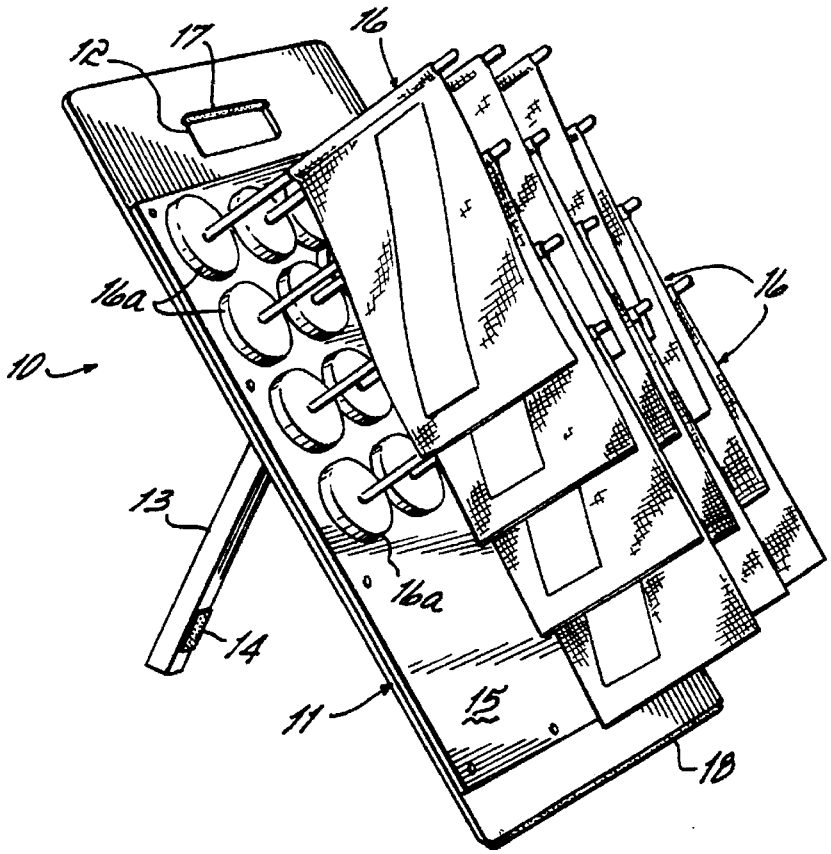
FIG. 1 is a perspective view showing a portable flag stand of the present invention with a plurality of flags having magnetic base portions attached thereto.

Referring to the Figures, a preferred embodiment of a portable flag stand 10 of the present invention is shown. The depicted embodiment has a rectangular cross-section. It will be appreciated that any other cross section can be utilized, particularly square, triangular, and hexagonal.

Flag stand 10 has a main body plate 11 and a support leg 13 for maintaining the flag stand in a usable position, as depicted in the Figures. In a preferred embodiment, the main body plate 11 is made of a material that is not adapted to releasably secure flags 16 with magnetic base portions **16*a*. It will be appreciated that the main body plate 11 can be made of virtually any material, particularly plastic, wood, fiberboard, light weight metal, or Plexiglas, to provide an inexpensive and lightweight flag stand 10**.

The preferred embodiment of the flag stand 10 also includes a sheet metal surface 15 that is attached to the main body plate 11. The sheet metal surface 15 can be attached to the main body plate 11 by any number of methods, particularly by rivets, screws, nails, glue, adhesive strips, or by crimping the ends of the sheet metal plate 15 over the ends of the main body plate 11.

In an alternative embodiment of the flag stand 10 not depicted in the Figures, the main body plate 11 could be made of a metallic material that is adapted for releasably securing flags 16 having magnetic base portions **16*a*. In this alternative embodiment, the sheet metal surface 15 would not be required because the flags 16 would attach directly to the main body plate 11. In yet another embodiment, sheet metal surface 15 can be covered with a layer of rubber or plastic that is thin enough for the magnetic base portions 16*a* to be releasably secured to the main body plate 11**.

As shown, the flag stand 10 of the present invention has a handle 12 integral with the main body plate 11. The handle 12 is cut out of the main body plate 11 and can have any number of geometric cross-sections, particularly rectangular, circular, or square. The main body plate 11 has rubber or plastic trim 18 to protect the main body and to prevent the flag stand 10 from sliding when it is in use. The handle 12 is adapted for a human hand to pick up and carry the flag stand 10 of the present invention. There is also a rubber or plastic handle grip 17 to help protect the hand when the flag stand 10 is being carried. Alternatively, the handle 12 can be a separate element coupled to the main body plate 11 of the flag stand 10 of the present invention. It will be appreciated that such a handle 12 can be coupled to the main body plate 11 by screws, rivets, clamps, or hooks.

Figure 2:
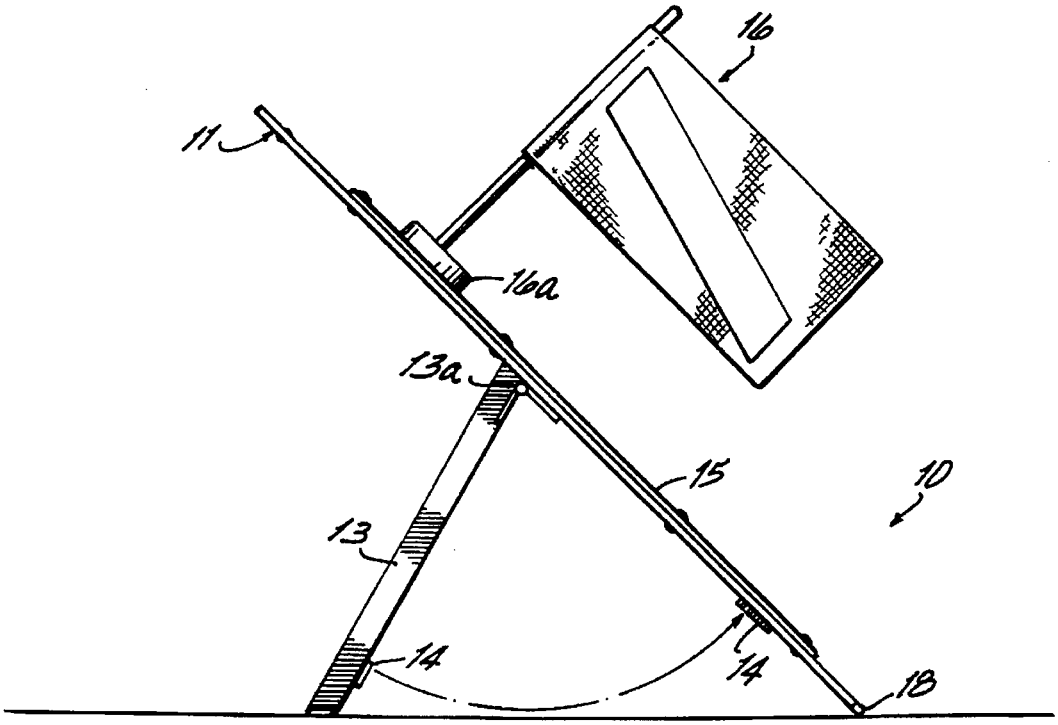
FIG. 2 is a side view of a flag stand of the invention with a single flag having a magnetic base portion attached thereto.

Referring to FIG. 2, the support leg 13 has one end 13*a* pivotally coupled to the main body plate 11, allowing the support leg 13 to be moved into open and closed positions. It will be appreciated that the support leg 13 can be pivotally coupled to the main body plate 11 in any number of ways, particularly by a hinge, a strap, a ring assembly, or a bracket and screws.

The support leg 13 and the main body plate 11 also have a cooperating fastener 14 for securing the support leg 13 to the main body plate 11 in a closed position when the flag stand 10 is not being used (not specifically shown in the Figures). It will be appreciated that the fastener 14 can be any type of conventional fastener, including a snap, a strap, a buckle, velcro strips, a clip, a magnetic fastener, or a ball and socket fastener.

Having thus described the flag stand of the present invention, it will be appreciated by persons skilled in the art that various modifications can be made to the structures shown and described herein without departing from the spirit and scope of the present invention, as defined in the appended claims.

What is claimed is:

1. A combination free-standing portable flag stand and flags, said combination comprising:

a main body including a plate for releasably securing flags each having a magnetic base portion, and a support leg for supporting said flag stand in a usable position; and a plurality of flags each having a magnetic base portion which are releasably securable to said main body plate.

2. The flag stand of claim 1 further comprising a carrying handle.

3. The flag stand of claim 2, said handle adapted for carrying said flag stand and being integral with said main body plate.

4. The flag stand of claim 2, said handle adapted for carrying said flag stand being coupled to said main body plate.

5. The flag stand of claim 1, said support leg having at least one end pivotally coupled to said main body plate.

6. The flag stand of claim 5, said support leg and said main body plate having a cooperating fastener for securing said support leg to said main body plate in a closed position.

7. A combination free-standing portable magnetic flag stand and flags, said combination comprising:

a main body including a plate, a sheet metal surface on said main body plate for releasably securing flags each having a magnetic base portion, and a support for maintaining said flag stand in a usable position; and a plurality of flags each having a magnetic base portion which are releasably securable to said main body plate.

8. The flag stand of claim 7 further comprising a carrying handle.

9. The flag stand of claim 8, said handle adapted for carrying said flag stand and being integral with said main body plate.

10. The flag stand of claim 8, said handle adapted for carrying said flag stand and being coupled to said main body plate.

11. The flag stand of claim 7, said main body plate having one side fastened to said sheet metal surface.

12. The flag stand of claim 7, said support leg having at least one end pivotally coupled to said main body plate.

13. The flag stand of claim 12, said support leg and said main body plate having a cooperating fastener for securing said support leg to said main body plate in said closed position.

* * * * *